United States Patent [19]

Eberle et al.

[11] Patent Number: 4,681,664

[45] Date of Patent: Jul. 21, 1987

[54] PROCESS FOR PRODUCING PIECES OF JEWELRY FROM PRECIOUS METALS AND PIECES OF JEWELRY PRODUCED BY IT

[75] Inventors: Rudolf Eberle, Knittlingen; Wilfried Essert, Pforzheim; Herbert Kull, Neuenbürg, all of Fed. Rep. of Germany

[73] Assignee: Juwedor GmbH, Fed. Rep. of Germany

[21] Appl. No.: 830,633

[22] Filed: Feb. 18, 1986

[30] Foreign Application Priority Data

Mar. 19, 1985 [DE] Fed. Rep. of Germany ..... 3509791
Dec. 21, 1985 [DE] Fed. Rep. of Germany ..... 3545549

[51] Int. Cl.[4] ..... C25D 1/02
[52] U.S. Cl. ..... 204/9
[58] Field of Search ..... 204/3, 4, 8, 9

[56] References Cited

U.S. PATENT DOCUMENTS 1,792,542 2/1931 Laukel ..... 204/9

*Primary Examiner*—T. M. Tufariello

[57] ABSTRACT

Pieces of jewelry made from metal, particularly precious metal, are produced galvanoplastically, in that the precious metal is electrodeposited on an electrically conductive mould core having the spatial contour of the piece of jewelry and on reaching the desired coating thickness the mould core material is dissolved chemically or thermally from the jewelry body. In order to produce pieces of jewelry or parts thereof, which are exposed to mechanical stresses, the hollow jewelry body obtained is provided with a solid area made from the same metal in those parts of the jewelry item undergoing more pronounced mechanical stressing during further working or correct use. In this way, e.g. pendant eyes, connecting or joining members on bands, necklaces or the like, rings in the vicinity of the rim, brooches, supports, hooks, clasps or the like can be reinforced by a solid construction, so that at these points the piece of jewelry can either be subsequently worked or can absorb repeated stresses, such as tensile and bending stresses, wearing stresses or the like.

15 Claims, 21 Drawing Figures

PROCESS FOR PRODUCING PIECES OF JEWELRY FROM PRECIOUS METALS AND PIECES OF JEWELRY PRODUCED BY IT

BACKGROUND OF THE INVENTION

The present invention relates to a process for producing pieces of jewelry from metal, particularly precious metal galvanoplastically, in that the metal is electrodeposited on an electrically conductive mould core having the spatial contour of the piece of jewelry and after reaching the desired coating thickness the mould core material is dissolved chemically or thermally from the hollow jewelry item. The invention also relates to pieces of jewelry produced by this process.

The use of galvanoplastics or electroforming has long been known in the manufacture of jewelry from precious metals. However, for a very long time the process has been limited to a few applications, particularly for the production of replicas of valuable originals or voluminous pieces of jewelry, in which a solid construction would lead to an excessive weight. It was disadvantageous that electrodeposition from gold baths was only possible with a relatively high carat value. However, of late, baths and technologies have been developed permitting the deposition in random carat values as from 8 carat. This has lead to a revival of this jewelry industry procedure so that now pieces of jewelry with a random shape and carat content can be produced galvanoplastically. The coating thickness is a few hundred microns, so that corresponding light pieces of jewelry can be manufactured, which, despite there hollow construction, have an adequate dimensional stability.

With regards to the technology it is pointed out that the mould core is produced in a conventional manner in a negative model or pattern of the piece of jewelry by slush moulding, the material in question being constituted by any random material which can be thermally or chemically liquefied or volatilized without the precious metal suffering. Apart from metals, in the case of materials which are not in themselves electrically conductive, such as e.g. waxes, they are coated in an electrically conductive manner, e.g. with metal. The separation of the core material from the precious metal body then takes place either thermally or chemically and in the deposited precious metal coating either an opening is provided or this is subsequently made to enable the core material to escape. In the case of metallically coated wax, this can optionally be dissolved out before hand and the then hollow mould core is used in the galvanic bath.

Due to the limited wall thickness, in many pieces of jewelry problems occur at points where there will be greater mechanical stressing during subsequent working or correct use. Although a hollow profile can be made adequately stable against tensile and bending stresses in the case of a correspondingly large wall thickness, a hollow profile with a limited wall thickness is e.g. sensitive to scouring or abrading repeated stressing, because the wall thickness is gradually worn away with the increasing period of use. Also when the hollow profile is used for mounting, guiding or fixing other parts, particularly moving parts, damage can occur. This can e.g. apply in the case of loops or eyes of pendants, for the rail, strip or rim of rings, for the connection parts of movable elements or fastenings on chains, bracelets or the like, as well as for brooches, supports, hooks, catches or the like.

SUMMARY OF THE INVENTION

The problem of the present invention is to so further develop the aforementioned process that it is also possible to produce high-quality pieces of jewelry with a durable stability.

According to the invention this problem is solved in that the hollow jewelry body is provided with a solid metal area in those regions of the article of jewelry which during subsequent working or correct use are more strongly mechanically stressed.

The inventive process makes it possible to manufacture pieces of jewelry of a random type with a limited wall thickness, which have a durable stability, even if they are zonally strongly stressed, in that following the galvanoplastic deposition of the metal, particularly precious metal on the solid or hollow mould core and after dissolving out the core material, the hollow jewelry body in this stressed area is subsequently filled with metal, so that the metal is present in solid form there and stabilizes the piece of jewelry in said areas. The jewelry body can be wholly or partly constructed as a closed hollow body.

Thus, e.g. in the manufacture of pieces of jewelry with connecting members allowing a movement, e.g. eyes or loops on pendants, movable intermediate members on bands, necklaces or the like, the hollow connecting member can at least partly be filled with metal. Furthermore, in the case of bracelets, chains or the like having end pieces for forming or mounting fastenings, the hollow end pieces can be zonally filled with metal. In the case of ear jewelry or the like with extensions for receiving or mounting pins, loops or springs, the hollow extensions are at least partly filled, whilst in the case of rings, the hollow ring rim can be zonally filled with the metal.

In all cases, in the reinforced areas, there is a greater bending and tensile strength through increasing the dimensional stability and also a greater resistance to wear in the case of scouring or abrading stressing. The further advantage arises with rings that, despite the substantially hollow construction, a subsequent modification to the ring diameter is possible, in that the otherwise hollow ring receives in this partial zone a solid ring rim, the said partial zone being chosen in such a way that it approximately covers the conventional ring diameter jumps. The filling of the hollow ring rim in this area preferably takes place by pouring in a metal with a lower melting point than the metal of the hollow jewelry body, it being conventional practice to use the same metals with a slightly differing alloy. Thus, when a modification to the ring diameter becomes subsequently necessary, the jeweller can sever the ring in the solid area and increase or decrease the diameter by shortening or inserting.

According to a development of the inventive process, at least on that part of the mould core located on the surfaces of the hollow jewelry body outside the subsequently to be filled area on the visible side of the piece of jewelry, the metal is deposited with a reduced coating thickness.

As a result of this process, outside the area which is to be subsequently made solid, there is a lesser wall thickness which can be separated without difficulty, so that the then accessible remaining partial area of the hollow space can be filled, whereas otherwise there is a type of hollow relief. Through the separated area the core material can be removed following galvanoplastic production.

According to a modified construction, electrolytic screening takes place in at least that part of the mould core located outside the subsequently to be filled area on the surfaces of the hollow jewelry body remote from the visible side of the piece of jewelry, so that no metal is deposited there. Thus, the hollow space of the jewelry body is open to the outside, with the exception of the area which is to be solidly filled.

Another variant of the inventive process is characterized in that at least on that part of the mould core outside the subsequently to be filled area on the surfaces of the hollow jewelry body remote from the visible side of the piece of jewelry, linear depressions, protuberances edges or non-conducting coverings are provided, which leave behind a weakened desired breaking line in the deposited metal coating. Preferably the mould core is provided with two spaced linear depressions, protuberances, edges or coverings and the metal coating between these is separated after dissolving the mould core from the jewelry body.

In the case of the jewelry bodies produced according to this process, the uncoated area or the area to be separated is preferably located on the inner faces of the piece of jewelry remote from the visible side.

In a preferred development of the latter variant, the two spaced edges on the mould core are formed by the upper edges of a groove therein. During electrodeposition this groove leads to desired breaking lines being formed in the metal coating along the groove edges, so that the metal can be separated without difficulty. According to a further preferred development, in the case of ring-like or hoop-like pieces of jewelry, the ring groove on the mould core is only located in the area outside the zone which is to be subsequently filled, so that the hollow space is close there and is only open to the sides.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
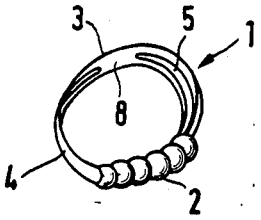
FIG. 1. a perspective view of a jewelry ring.

The piece of jewelry in the form of a ring 1 perspectively reproduced in FIG. 1 is provided in its upper region, i.e. the ring head 2 with a decoration. The ring rim 4, as is generally the case, has a decreasing thickness from ring head 2 to the lower area 3. The complete ring is galvanoplastically produced as a hollow body, whose cross-section is visible at the transition of ring rim 4 into ring head 2 in FIG. 4.

Figure 2:
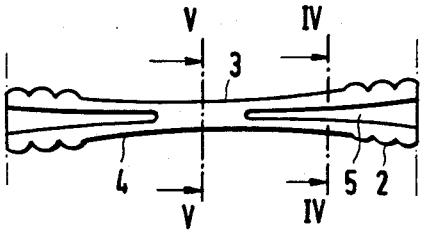
FIG. 2. a development of the jewelry ring according FIG. 1 with a view of the inner circumferential surface in an intermediate stage of the process.
Figure 4:
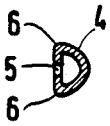
FIG. 4. a section IV—IV according to FIGS. 2 and 3.

In the represented embodiment, the ring is provided on its inside with a slot 5 which, as is particularly shown in FIG. 4, is spaced from the edges 6 of ring rim 4. During the galvanoplastic production of the jewelry ring 1, the slot 5 is obtained in that a correspondingly annular desired breaking zone is produced by a ring groove on the mould core and is subsequently separated, as is apparent in the development according to FIG. 2. In the lower area 3 of ring rim 4, the hollow space remains closed except for the lateral openings. The material forming the hollow space can be removed through these openings.

Figure 3:
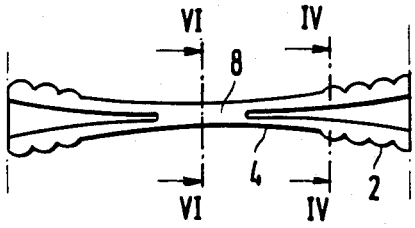
FIG. 3. a development corresponding to FIG. 2 in the final state.
Figure 5:
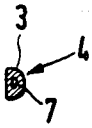
FIG. 5. a section V—V according to FIG. 2.
Figure 6:
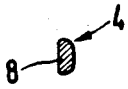
FIG. 6. a section VI—VI according to FIG. 3.
Figure 14:
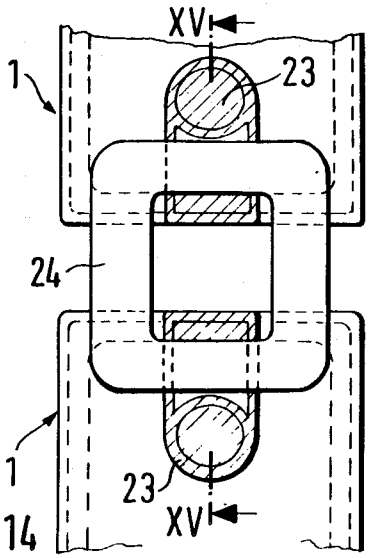
FIG. 14. a section through the end piece according to FIG. 13 in the plane of the piece of jewelry.

In the lower area 3 of ring rim 4 the previously present hollow space 7 (FIG. 6) is filled with precious metal to give a solid part 8 (FIGS. 1, 3, and 5), so that the ring rim 4 has the cross-section there shown in FIG. 6. To modify the ring diameter, the ring 1 can be separated in the solid part 8 and then either widend or narrowed.

Figure 13:
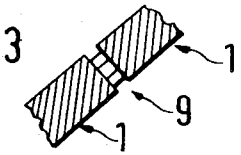
FIG. 13. a perspective partial view of a further embodiment of a band-like piece of jewelry.
Figure 10:
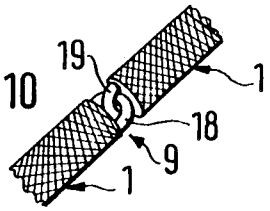
FIG. 10. a perspective partial view of another embodiment of a band-like piece of jewelry.
Figure 12:
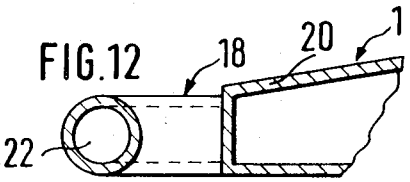
FIG. 12. a section XII—XII of FIG. 11.
Figure 8:
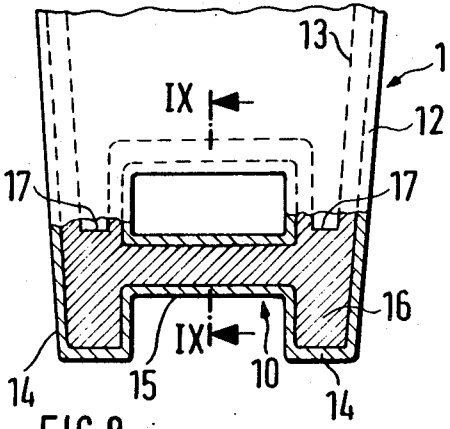
FIG. 8. a section through one of the end pieces of the piece of jewelry according to FIG. 7 in the plane thereof.
Figure 7:
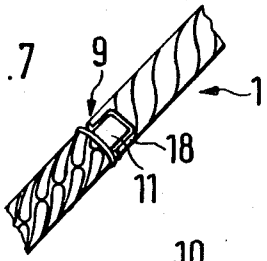
FIG. 7. a perspective partial view of a piece of jewelry in the form of a chain or band.
Figure 9:
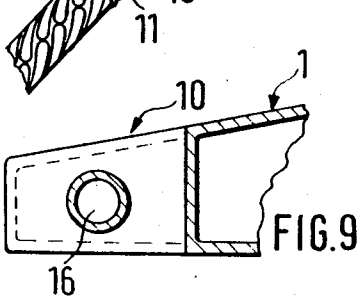
FIG. 9. a section IX—IX according to FIG. 8.

FIGS. 7, 10 and 13 show different embodiments of pieces of jewelry 1 in the form of bands, necklaces or the like, which have one or more movable connections 9. In the embodiment according to FIG. 7, the piece of jewelry 1 is in the form of a curb chain, onto whose one end is cast a connecting member 10 and whose other end has a matching connecting member 11 and after the joining thereof a movement between the two band ends is possible. The connecting member 10 is shown in greater detail in FIGS. 8 and 9. Like the complete band, it has a wall thickness 12 and is constructed as a hollow body, the inner boundary 13 of the hollow body being separable either as a result of a still thinner wall thickness or on the basis of desired breaking lines.

The connecting member 2 has two legs 14 and a pin 15 connecting them and which can also be hollow. A recess is positioned behind pin 15. After separating or removing inner wall 13 access is possible to the hollow space surrounded by legs 14 and pin 15 via openings 17. Space 16 can be filled with solder via these openings, so that this area of connecting member 10 is made solid and can absorb the forces occurring between the two connecting members 10, 11, the connecting member 11 embracing in articulated manner pin 15 on connecting member 10.

Figure 11:
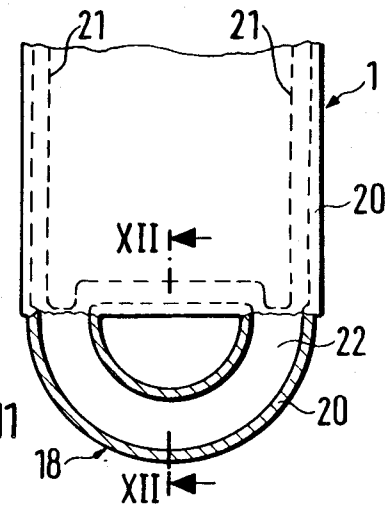
FIG. 11. a section through one of the end pieces of the piece of jewelry according to FIG. 10 in the plane thereof.

In the embodiment according to FIG. 10 the two connecting members 18, 19 of the band-like piece of jewelry 1 are again obtained in one piece therewith by galvanoplastic deposition. In this case the connecting members 18, 19 are designed in part-circular form like chain links and as shown in FIG. 11 by means of connecting member 18. The latter, like the actual band has a thin wall 20. The band is terminated on its underside by an optionally still thinner wall, which can be separated out via desired breaking lines 21. Thus, the closed space 22 of connecting member 18 is accessible from the inside and can be filled with solder.

Figure 15:
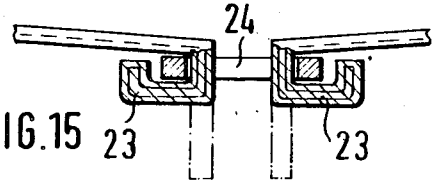
FIG. 15. a section XV—XV according to FIG. 14.

In the embodiment according to FIG. 13, there is once again a movable joining member 9 on a band-like piece of jewelry 1. In this embodiment, the joining member 9 is on the one hand formed by connecting members 23 on the ends and on the other hand by a separate fastening 24. The connecting members 23 are hereagain in one piece with the band-like jewelry item 1, whilst in the initial position they roughly have the dotted line configuration of FIG. 15. They are filled with precious metal solder after electroforming, so that they have a solid construction. After filling the ring-like joining member 24 is passed over the same and subsequently the connecting members 23 are bent over into the position shown in FIG. 15. Thus, hereagain, the thin-walled piece of jewelry obtained by electroforming can be subsequently worked at the more stressed points.

Figure 16:
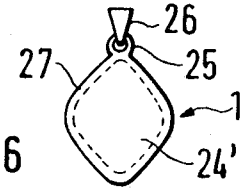
FIG. 16. a view of a pendant with a loop.
Figure 17:
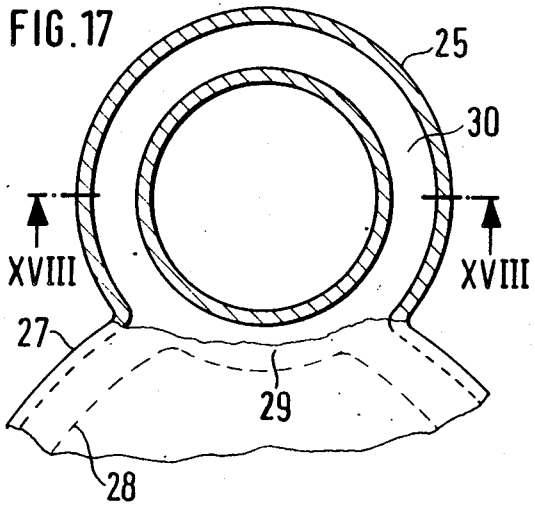
FIG. 17. a section in the ring loop plane.
Figure 18:
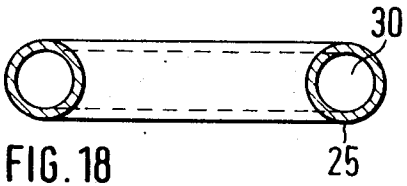
FIG. 18. a section XVIII—XVIII according to FIG. 17.

FIG. 16 shows a piece of jewelry 1 in the form of a pendant 24 with an eye 25 as the connecting member for the loop 26 of a chain or the like. The pendant 24 again has a thin wall 27, which is separated out at the back so that a type of hollow relief is formed. During said separating out or removal, which e.g. takes place along the desired breaking line 28 in FIG. 17, in the region 29 of eye 25 an opening is formed giving access to space 30 of the eye, so that the latter can be filled with solder.

Figure 19:
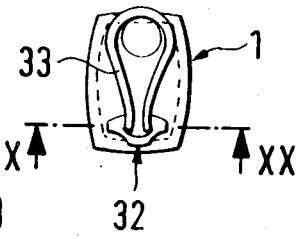
FIG. 19. a view of the back of an ear clip.
Figure 21:
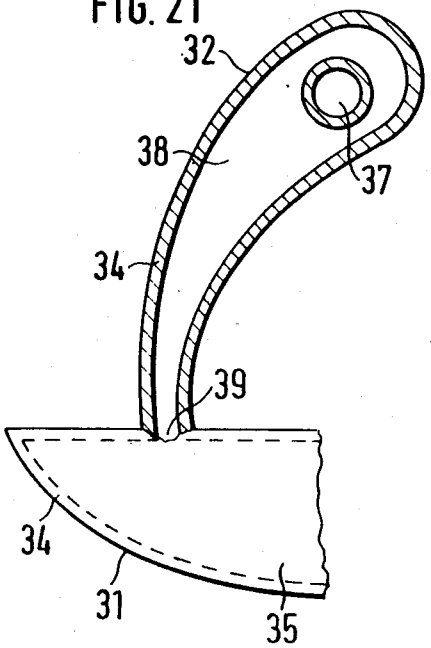
FIG. 21. a section XXI—XXI according to FIG. 20.

FIG. 19 shows a piece of jewelry 1 in the form of an ear clip in the form of a rear view, the front 31 being shown in FIG. 21. On the back of the ear clip, a mount 32 is formed in one piece therewith and is used for mounting a clamp strap 33 for fitting to the ear.

Figure 20:
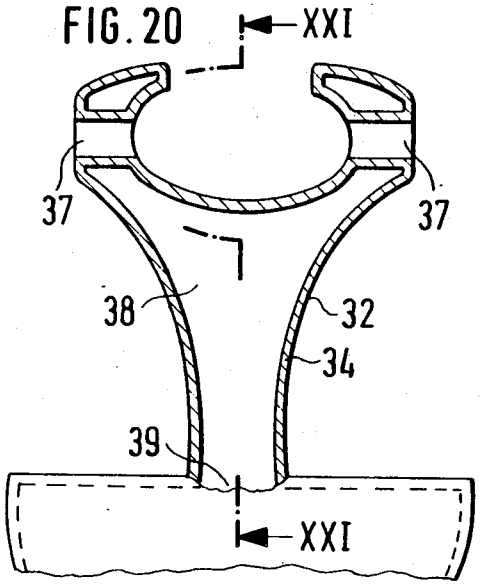
FIG. 20. a section XX—XX according to FIG. 19.

Hereagain, the actual ear clip is produced with a thin wall 34, accompanied by the formation of a space 35, which extends into the mount 32. As shown in FIG. 21, said mount 32 curves inwards and is made fork-like at its end (cf FIG. 20). A transversely directed bearing 37 is provided in each of the two fork legs 36 and the opposite ends of strap 33 can be resiliently inserted therein. Mount 32 is hollow, space 38 being accessible via openings 39 and can be filled with solder.

What is claimed is:

1. A process for the production of pieces of jewelry made from metal wherein metal is electrodeposited on an electrically conductive mould core having the spatial contour of the piece of jewelry and on reaching the desired coating thickness the material of the mould core is removed from the electrodeposited metal to leave a hollow jewelry body made of said electrodeposited metal, and wherein said hollow jewelry body is thereafter provided with a solid zone made from metal in at least one area of the piece of jewelry which is likely to be thereafter more strongly stressed than other areas of said piece of jewelry.

2. A process according to claim 1, for the production of pieces of jewelry with connecting members allowing mobility wherein at least one of said connecting members is initially hollow and is at least partly filled with metal.

3. A process according to claim 1, for producing link jewelry with end pieces wherein said end pieces are initially hollow and are at least partly filled with the metal.

4. A process according to claim 1, for producing pieces of jewelry with extensions wherein said extensions are initially hollow and are at least partly filled with the metal.

5. A process according to claim 1, for producing rings wherein a ring after removal of the material of the mould core includes a hollow ring rim, and wherein at least a part of said hollow ring rim is subsequently filled with metal.

6. A process according to claim 1, wherein the metal is deposited with a reduced coating thickness over a part of the mould core adjacent a subsequently to be filled area on a face of the hollow jewelry body remote from the visible side of the piece of jewelry.

7. A process according to claim 1, wherein electrolytic shielding takes place on the mould core over a part thereof adjacent a subsequently to be filled area on a face of the hollow jewelry body remote from the visible side of the piece of jewelry.

8. A process according to claim 1, wherein on a part of the mould core which is adjacent a subsequently to be filled area of the hollow jewelry body and which is remote from the visible side of the piece of jewelry the mould core is provided with a linear feature which leaves behind a weakened desired breaking line on the deposited coating.

9. A process according to claim 8, wherein the mould core is provided with two spaced linear features, and wherein the metal coating between the breaking lines created by said two spaced linear features is separated from the jewelry body after the removal of the mould core.

10. A process according to claim 6, wherein the reduced coating thickness of the metal is located on an inner face of the hollow jewelry body remote from the visible side of the piece of jewelry.

11. A process according to claim 8, wherein said linear feature on the mould core is formed by the upper edge of a groove therein.

12. A process according to claim 11, wherein said groove passes over the entire inner circumferential surface of the mould core, with the exception of that area corresponding to the subsequently to be filled area of the jewelry body.

13. A process according to claim 1, wherein the metal is soldered into the area of the hollow jewelry to be filled.

14. A process according to claim 1, wherein the area of the jewelry body to be filled is slush moulded with a metal alloy with a lower melting point than the metal forming the jewelry body.

15. A piece of jewelry produced according to the process according to claim 1 which is at least partly constructed as a closed hollow body which hollow body is made solid in at least one area likely to be subjected to greater mechanical stressing than other areas which are left hollow.

* * * * *